US007319188B1

(12) United States Patent
Birkhamshaw et al.

(10) Patent No.: US 7,319,188 B1
(45) Date of Patent: Jan. 15, 2008

(54) STRINGED INSTRUMENT ELECTRONIC PICKUP

(76) Inventors: Gary Upton Birkhamshaw, 9 Jackson Ave., Mystic, CT (US) 06355; Eric Rene Roy, 75 Capon Farm Dr., Warwick, RI (US) 02886

( * ) Notice: Subject to any disclaimer, the term of this patent is extended or adjusted under 35 U.S.C. 154(b) by 50 days.

(21) Appl. No.: 11/440,239

(22) Filed: May 25, 2006

(51) Int. Cl.
*G10H 3/18* (2006.01)

(52) U.S. Cl. ..... 84/731

(58) Field of Classification Search ..... 84/730, 84/731, DIG. 24
See application file for complete search history.

(56) References Cited

U.S. PATENT DOCUMENTS 3,325,580 A * 6/1967 Barcus et al. ..... 84/731
4,054,808 A * 10/1977 Tanaka ..... 310/323.21
4,147,084 A 4/1979 Underwood
4,785,704 A 11/1988 Fishman
5,911,171 A * 6/1999 Wong ..... 84/731

* cited by examiner

*Primary Examiner*—Lincoln Donovan
*Assistant Examiner*—Andrew Millikin
(74) *Attorney, Agent, or Firm*—Robert A. de Groot

(57) ABSTRACT

A piezo-electric sound pickup device for a stringed instrument having a wood or other shapeable material for a casing that is slightly larger than the standard gap between the wing and leg of the instrument bridge. The sound pickup device can be sanded to the proper dimension to properly fit this wing to leg gap. The installation of the pickup after proper sizing does not change the tone of the instrument and does not require further shim installation.

11 Claims, 1 Drawing Sheet

STRINGED INSTRUMENT ELECTRONIC PICKUP

BACKGROUND OF THE INVENTION

Musical instruments in the string family have a relatively softer tone than other instruments and consequently need amplification to match the output of other instruments in a band such as trumpet, sax, trombone and drum. This invention relates to an adjustable piezoelectric pickup that is secured on a string instrument bridge between a wing and a leg section. An adjustment is made to the original thickness of the pickup by sanding the flat wooden surface to the open dimension on the bridge beneath that wing section.

Sound pickup devices for stringed musical instruments have been typically air coupled devices, soundboard contact pickups and electromagnetic string motion detectors. The air coupled devices have the problem of sensing sounds from the environment other than the instrument itself. The contact pickups are limited in the quality of sound due to various deficiencies in reproducing the entire frequency range of the strings, which have multiple octave overtones and other frequencies. The magnetic pickups can only function with magnetic steel strings. Consequently a preferred type of device is the piezo-electric transducer for the stringed instrument family that can be wedge-mounted on the bridge of the instrument.

A type of this device is disclosed in U.S. Pat. No. 4,147,084 by Underwood. This pickup consists of a pair of pickups mounted between the legs and wings of the bridge of a bass viol. A brass case of slightly less than 4 mm (5/32 in.) contains a piezoelectric transducer for each device. This device will need a pair of shims to provide proper contact of both surfaces of the typically 5 or 6 mm gap that is on a standard bass viol bridge. This shim requirement is silent in the disclosure therefore removal of wood from the bridge would be required.

A second type of pickup is disclosed in U.S. Pat. No. 4,785,704 by Fishman in which a single pickup is mounted in the gap between the wing and the bridge of the violin family. Contact is maintained by an integral spring that will provide a snug fit in a violin for gaps between 1.3 and 2.3 mm (0.05 and 0.09 in.). The other instruments in the violin family, having a larger gap and therefore would require a shim to make a proper fit. On a banjo the pickup is mounted between the bridge and the body utilizing a separately manufactured spacer to maintain the proper fit. The pickup for a mandolin and guitar also requires a separate spacer. The upper and lower pickup surfaces of this device are of metallic copper and are part of the electrical signal transmission. Other methods of mounting electronic pickups on the string family require special bridge construction or modifications to a standard bridge which is undesirable for the end user of the instrument.

It is the purpose of this invention to provide an adjustable thickness pickup that can be inserted within the gap between the wing and leg of a typical string instrument bridge by an end user. The thickness of the pickup is carefully machined to be slightly larger than the standard gap of instruments in the violin family. The workable casing material, e.g. wood and soft plastic, is easily sanded by the owner to fit the instrument bridge gap. This device therefore avoids the need to modify the instrument bridge and also the need for separate and fitted shims as stated above in the prior art.

DETAILED DESCRIPTION

Figure 1:
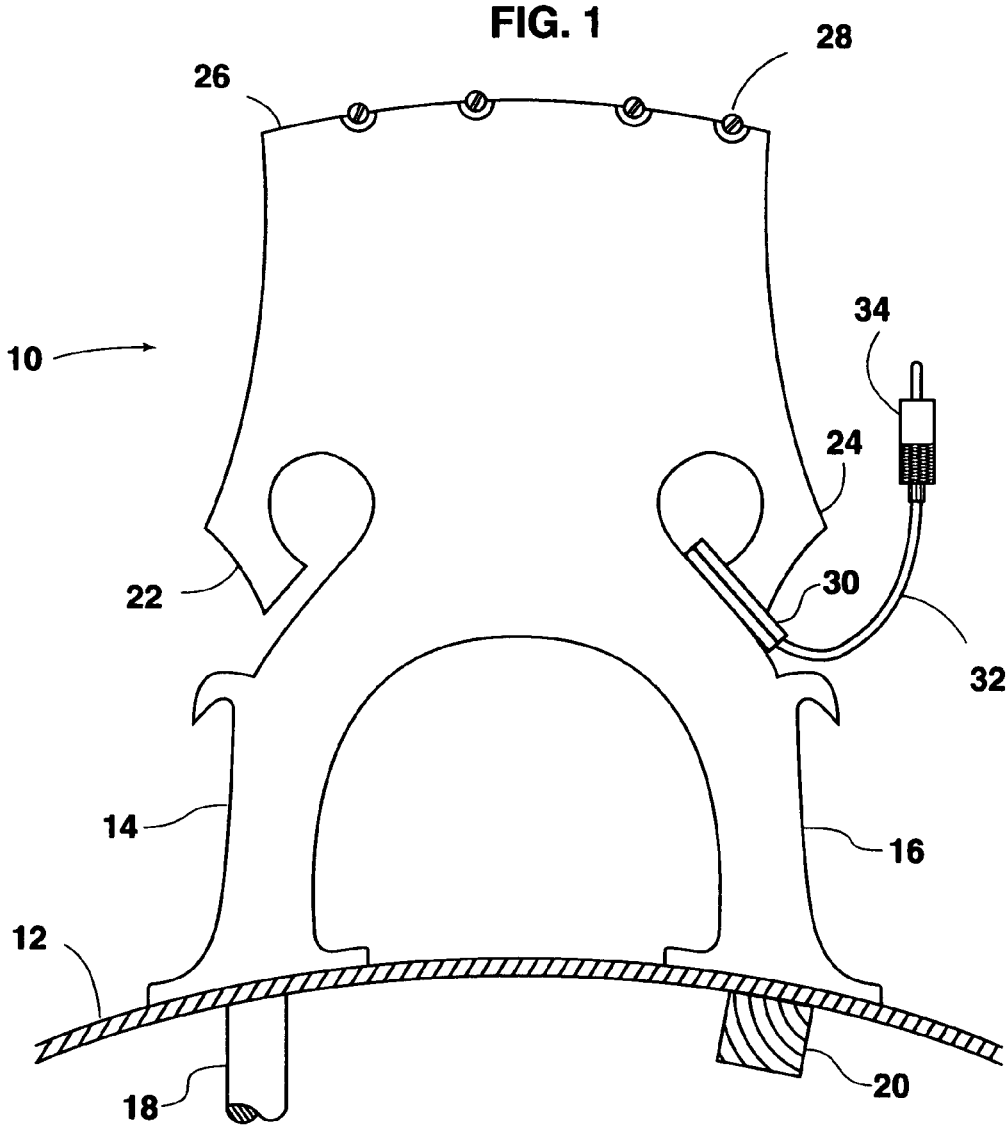
FIG. 1 is a top section view of a stringed instrument bridge and piezoelectric pickup of the present invention.

The following description will be for a stringed bass instrument but the same concepts, description and drawings are applicable to violins, violas and cellos in the violin family. The typical bridge for a stringed instrument is illustrated by FIG. 1 which is looking down at the bridge of a bass violin. Bridge 10 rests on the center of sound board 12 of the instrument and a pair of legs 14 and 16 are positioned over the sound post 18 and bass bar 20. On the side of bridge 10 are a pair of wings 22 and 24. The strings of the instrument are stretched over the top portion 26 of bridge 10, the low string being at 28. The preferred location for piezoelectric pickup 30 is as shown between wing 24 and leg 16 positioned over the bass bar 20 there by providing a most accurate tone from the pickup 30. This signal is transmitted via coaxial cable 32 and RCA plug 34 to an attached plug receptacle mounted below the bridge on the tailpiece (not shown). The plug receptacle in turn connects to a remote amplifier and speaker, also not shown. These plugs permit removal of the pickup from the instrument if not needed. The insertion of the pickup 30 under the wing 24 does not affect the tone of the bass if the amplifier is not used.

Figure 2:
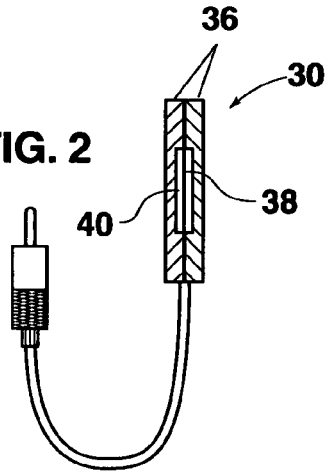
FIG. 2 is side view of the pickup.

A side view in FIG. 2 illustrates the slim profile of the piezoelectric pickup 30 which for the bass violin is carefully manufactured to be 7 to 7.5 mm in thickness. This thickness is approximately 2 mm thicker than the gap between the wing and leg of a standard bass bridge. The pickup 30 can also be inserted in the post 18 side of the bridge under wing 22 if desired since the gap will be the same. The unique feature here is the use of an easily workable material such as wood or one of the softer plastics for the two halves of the casing 36. The preferred material here is wood for both halves of the casing 36. The wood casing 36 compresses a pliable material 38 against the piezo-electric transducer 40. This construction provides a pickup that resists feedback problems. A preferred pliable material 38 is cork. The choice of a soft wood for the casing 36 permits easy reduction of thickness of the pickup to properly fit in the 5 mm gap between wing 30 and leg 16 by sanding the flat surface of the wooden casing 36. The wooden face may be sanded to remove about 4 mm of wood surface before exposing the piezo-electric transducer.

Figure 3:
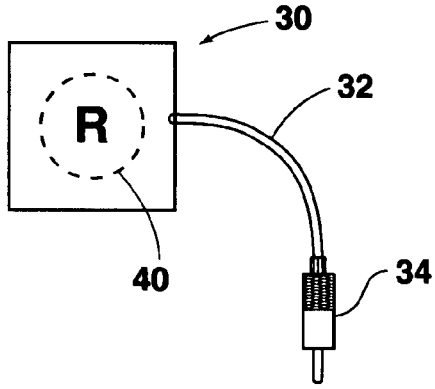
FIG. 3 is a plan view of the pickup.

FIG. 3 illustrates the top view of the pickup 30 with the piezoelectric transducer 40 shown in phantom. A letter "R" is imprinted on the top flat surface of the pickup 30 to indicate a referenced side to the installer so that he may determine orientation of his pickup if he removes it and replaces it later and also to indicate the side not to be sanded. The pickup may be inserted with either side facing the wing 24. The pickup 30 is square about 27 mm in width and its connecting coaxial cable about 20 cm in length.

Instructions for sanding the pickup for proper fit are provided to the user and include instructions for mounting of the plug receptacle that receives the RCA plug 34. Typically the user will have to remove only one or two millimeters of wood for a proper fit. The preferred soft wood for the case 36 is spruce to give the best tone reproduction.

The resulting pickup provides a superior sound reproduction and is retained on the bridge without the use of metal biasing springs or other spacing devices and is easily removable. The pickup also provides feedback resistance The pickup for a violin, viola and cello requires a case thickness of about 4 mm since the wing to leg gap on those instruments is about 4 mm less than the bass.

We claim:

1. In a stringed instrument having a wooden bridge and a pair of wings and legs of a known gap dimension, a sound pickup devise mounted between one of the gaps, the sound pickup device comprising:

(a) a piezo-electric transducer having a first face in contact with a pliable material and a second face in contact with a first half of a wooden case; and (b) a second half of the case in contact with the pliable material wherein a thickness of the assembled case, piezo-electric transducer and the pliable material is larger than the known gap of the stringed instrument wherein a device installation instruction includes a sanding procedure to insure proper fit of the device in one of the gaps.

2. The sound pickup device of claim 1 wherein the thickness of the assembled case is about 7 millimeters.

3. The sound pickup device of claim 1 wherein the case is made from spruce wood.

4. The sound pickup device of claim 1 wherein the pliable material is cork.

5. The sound pickup device of claim 1 wherein the stringed instrument is a bass violin.

6. The sound pickup device of claim 1 wherein the stringed instrument is a violin, viola or cello.

7. In a stringed instrument having a wooden bridge and a pair of wings and legs of a known gap dimension, a sound pickup device mounted between one of the gaps, the sound pickup device comprising:

(a) a piezo-electric transducer having a first face in contact with a pliable material and a second face in contact with a first half of a plastic case; and (b) a second half of the case in contact with the pliable material wherein a thickness of the assembled case, piezo-electric transducer and the pliable material is larger than the known gap of the stringed instrument wherein a device installation instruction includes a sanding procedure to insure proper fit of the device in one of the gaps.

8. The sound pickup device of claim 7 wherein the thickness of the assembled case is about 7 to 7.56 millimeters.

9. The sound pickup device of claim 7 wherein the pliable material is cork.

10. The sound pickup device of claim 7 wherein the stringed instrument is a bass violin.

11. The sound pickup device of claim 7 wherein the stringed instrument is a violin, viola or cello.

* * * * *